United States Patent [19]

Bjork

[11] Patent Number: 4,779,817

[45] Date of Patent: Oct. 25, 1988

[54] HAND WINDER

[76] Inventor: Leif Bjork, Linnegatan 58a, S 114 54 Stockholm, Sweden

[21] Appl. No.: 72,794

[22] Filed: Jul. 13, 1987

[30] Foreign Application Priority Data

Mar. 18, 1985 [SE] Sweden ..... 8501294

[51] Int. Cl.[4] ..... B65H 75/02

[52] U.S. Cl. ..... 242/96; 242/104; D8/358

[58] Field of Search ..... 242/96, 85.1, 104, 129; D8/358, 359; 24/129 R, 129 A, 129 B, 71.3

[56] References Cited

U.S. PATENT DOCUMENTS

| | | | |
|---|---|---|---|
| 4,174,702 | 3/1965 | French | 242/85.1 |
| 4,193,563 | 3/1980 | Vitale | 242/85.1 X |
| 4,261,529 | 4/1981 | Sandberg et al. | 242/96 X |
| 4,277,035 | 7/1981 | Gaski | 242/85.1 |
| 4,586,675 | 5/1986 | Brown | 242/85.1 |

FOREIGN PATENT DOCUMENTS

| | | |
|---|---|---|
| 2390360 | 12/1978 | France . |
| 600747 | 7/1934 | Fed. Rep. of Germany. |

*Primary Examiner*—Stuart S. Levy
*Assistant Examiner*—Steven du Bois
*Attorney, Agent, or Firm*—Leydig, Voit & Mayer, Ltd.

[57] ABSTRACT

A hand winder for winding and unwinding a line, cable or the like comprises a handle portion and a carrier portion for carrying the line or cable. In order to provide for a simple fast and powerful winding-in and paying-out of the line the carrier portion comprises two substantially parallel spaced carrier arms. One end of each arm is secured to one end of a pay-out handle of the handle portion, and protrudes freely therefrom. The handle portion comprises a pull-in handle arranged in parallel spaced relationship to the pay-out handle. The longitudinal axis of the pay-out handle lies substantially in the central perpendicular plane through the carrier arms. In a preferred embodiment the arms are outwardly splayed at an angle of about 6° to a central axis to hinder unintentional winding of a wound line.

6 Claims, 2 Drawing Sheets

HAND WINDER

BACKGROUND OF THE INVENTION

The present invention refers to a hand winder for winding and unwinding a line, cable or the like.

Handling of lines, wires, cables, hoses etc. often causes substantial problems. Lines are frequently stored either loosely in a circular configuration or wound on a bobbin or reel. If stored in a circular configuration a line easily becomes tangled when it is being paid out. If a line is wound on a spool or reel problems occur in paying the line out sufficiently fast, particularly when it is desired to throw the line and thereby achieve a substantial length of throw.

When a line is to be drawn-in or rewound, this usually has to be done by hand. The line is then liable to cut the hand, and it may also be difficult to seize the line reliably, particularly if the line is dirty or wet, and more particularly in cold weather. When the line is drawn-in by hand this usually results in a loose tangle of line lying at the feet of the operator, and this could be dangerous in certain situations. Reels, bobbins or the like hitherto known for winding and storing of lines, cables or the like do not provide for an effective and fast drawing-in of a line.

Examples of conventional winding and unwinding devices for lines, cables and the like are disclosed in French patent publication No. 2,390,360 and U.S. Pat. No. 4,261,529.

SUMMARY

An object of the present invention is to overcome the above-stated drawbacks of known reels.

In accordance with the invention a hand winder for winding and unwinding of a line, cable or the like comprises a handle portion and a carrier portion for carrying said line, said handle portion comprising a pay-out handle and a wind-in handle arranged in substantially parallel spaced relationship, said carrier portion comprising two substantially parallel spaced carrier arms, one end of each arm being connected to a respective end of said pay-out handle and protruding freely therefrom, said pay-out handle lying substantially in a central, perpendicular transverse plane through said carrier arms.

By using the winder according to the invention, a line or cable can be easily wound onto the winder while using the wind-in handle, and this enables very great pulling forces to be applied to the line if required.

When the line then is to be paid-out, the operator's grip is shifted to the pay-out handle, and the carrier arms will point in the direction of pay-out of the line, thus allowing the line to be paid out easily and freely. By changing the grip from the pay-out handle to the wind-in handle and vice versa with either hand, an operator can rapidly shift between winding-in and paying-out a line.

Furthermore, the fact that the winder has no moving parts whatsoever means that it should last indefinitely.

DESCRIPTION OF THE PREFERRED EMBODIMENTS

Figure 1A:
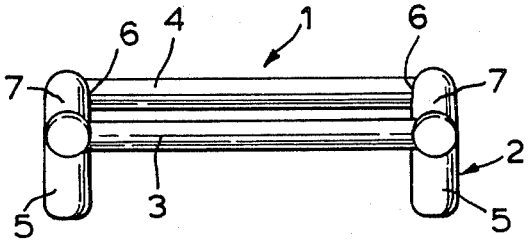
FIG. 1*a* is a front view of a winder according to the invention.
Figure 1B:
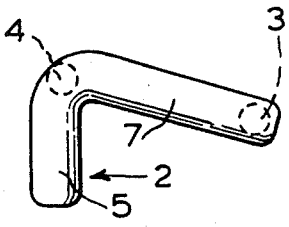
FIG. 1*b* is a side elevational view of the winder of FIG. 1*a;*
Figure 2:
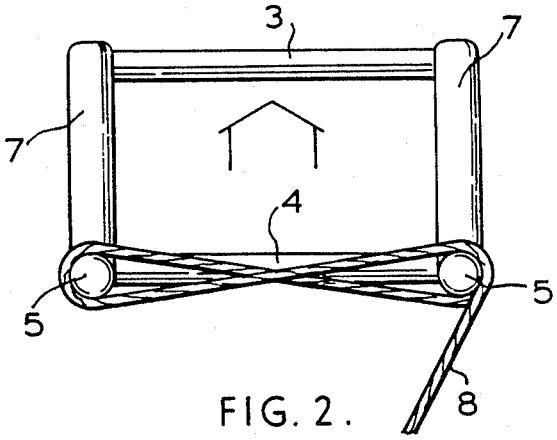
FIG. 2 is a plan view of the winder of FIG. 1 during winding of a line thereon.
Figure 3A:
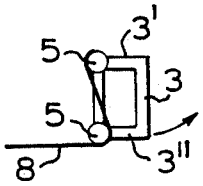
FIGS. 3*a–d* diagrammatically illustrate in plan view the principle of winding of a line onto a hand winder similar to the hand winder shown in FIG. 2.
Figure 3B:
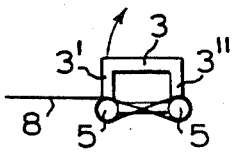
Figure 3C:
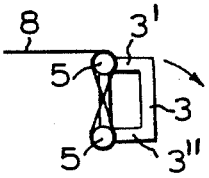
Figure 3D:
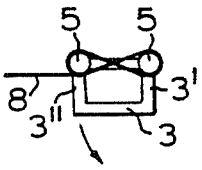

In the drawings, a hand winder according to the invention comprises a handle portion 1 and a carrier portion 2 for carrying the line or cable. The handle portion 1 comprises a wind-in handle 3 and a pay-out handle 4 arranged in substantially parallel spaced relationship. The carrier portion 2 comprises two carrier arms 5, which are arranged in substantially parallel spaced relationship. One end of each carrier arm 5 is connected at connection 6 to a respective end of the pay-out handle 4, the arms 5 protruding freely therefrom. The pay-out handle 4 and the carrier arms 5 define a first generally U-shaped member.

The wind-in handle 3 is arranged relatively to the carrier arms 5 so that it lies approximately in the central, perpendicular transverse plane through the carrier arms 5. The length of the carrier arms 5, as well as the length of the wind-in and pay-out handles 3, 4, which thus define the mutual spacing of the carrier arms 5, is suitably determined depending on the length and the coarseness of the line, cable or the like which is to be wound onto the winder.

The wind-in handle 3 may be connected to the connection 6 between the carrier arms 5 and the ends of the pay-out handle 4 by means of angularly-directed elongations or arms 7 of the carrier arms 5 extending from the connection 6 to the wind-in handle 3. Together, the wind-in handle 3 and the arms 7 define a U-shaped member located in a plane extending transversely to the plane of the U-shaped member defined by the pay-out handle 4 and the carrier arms 5. Alternatively, the wind-in handle 3 may be made with angularly-extending arm portions 3', 3'' (as shown in FIGS. 3*a–3d*), the ends of which are secured to the respective connections 6 between the carrier arms 5 and the ends of the pay-out handle 4.

For winding of a line or cable 8 the wind-in handle 3 is gripped in one hand, or if desired in both hands, the carrier arms 5 forming hook means, and by alternately moving the two carrier arms 5 above and below the line 8, as illustrated in FIGS. 3*a–d*, the line 8 is wound in the form of an "8" onto the two carrier arms 5.

Figure 4:
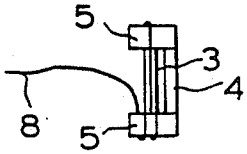
FIG. 4 illustrates the inverted winder of FIGS. 1 and 2 with the studs pointing in the direction of pay-out of a line.

For unwinding or paying-out the line 8, the pay-out handle 4 is held centrally and turned so that the carrier arms 5 point in the direction of pay-out of the line 8, i.e. substantially horizontal as shown in FIG. 4. If it is desired to move rapidly between winding in and paying out the line 8, the pay-out handle 4 is held in one hand and the wind-in handle 3 held in the other hand.

Figure 5:
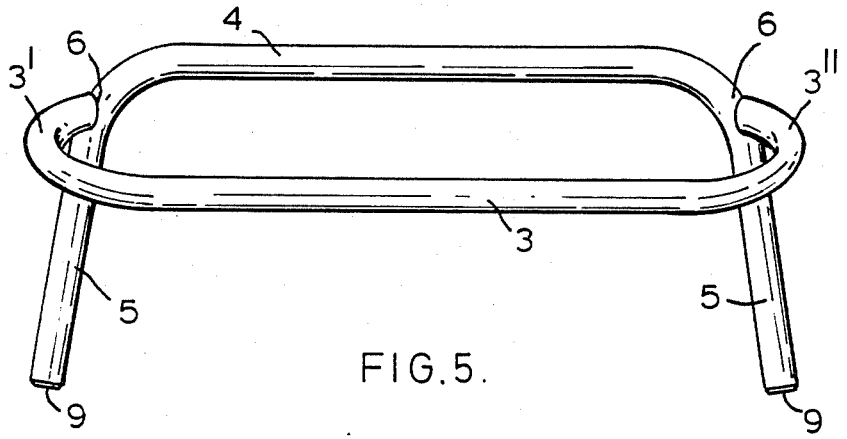
FIGS. 5 to 7 are respectively front, side and plan views of a further embodiment of a winder according to the invention.
Figure 6:
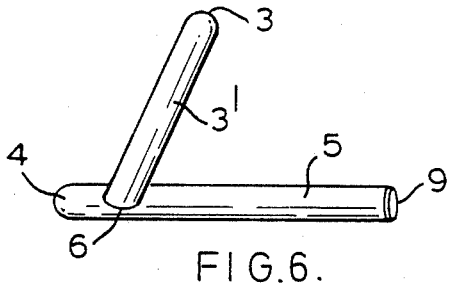
Figure 7:
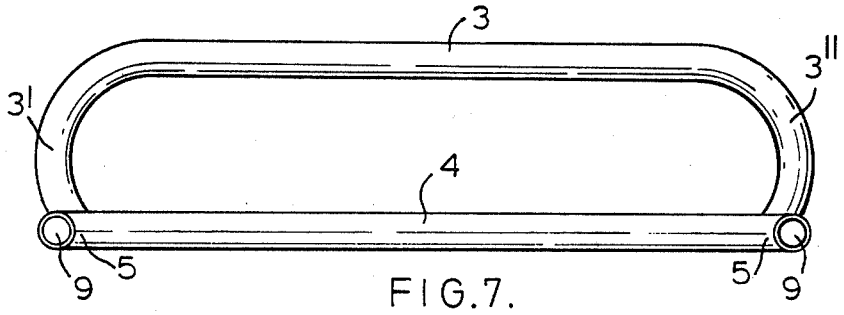

In FIGS. 1 to 4, the carrier arms 5 have been shown exactly parallel to each other in the drawing. However, they may be somewhat splayed outwardly away from each other so as to hinder unintentional unwinding of a wound line as shown in FIGS. 5 to 7. Here the winder is made of steel pipe and the pay-out handle 4 is continuous with the carrier arms 5 so as to form a first generally U-shaped member. The wind-in handle 3 is continuous with angularly-extending end or arm portions 3', 3'' so as to form a second generally U-shaped member. The arm portions 3', 3'' are welded to the area of connection 6 between the carrier arms 5 and the pay-out handle 4. Plastic plugs 9 are inserted in the ends of the carrier arms 5.

As can be seen more particularly from FIG. 5, the carrier arms 5 are at an angle of about 7° to a central axis 10 through the winder. The end portions 3', 3'' are at an angle of about 65° to the plane containing the carrier arms 5.

With a hand winder according to the present invention a line can be paid out rapidly without becoming entangled. This allows great throw lengths to be achieved, particularly in the case of a coarse line, which was previously impossible. It is also an advantage of the winder according to the invention that the line 8 can be wound in very fast and with great force. The speed with which the line 8 can be wound in is surpassed only by power capstans or similar mechanical devices handling fine lines like fishing-lines. The power obtainable by the winder is so great that it can be compared with geared capstans or pulleys.

The method of winding of the line 8 ensures that the line does not become entangled irrespective of how many times the line is paid out and re-wound. The winder according to the invention is hand-operated and portable, and therefore the user can always occupy the best possible position for handling the line, which previously was seldom possible. The size of the hand winder is small as is also the weight, and therefore the hand winder is easy to use, store and transport.

In principle, the hand winder according to the invention can be used everywhere where lines, wires, cables, hoses etc. are to be handled. As an example, it may be used in marine applications, particularly for leisure boats, in which very often a line attached to a grappling iron, a sail halyard, a mooring rope etc. is to be handled. The hand winder can also be used in connection with fishing, and also as a cable winder or support means for hoses, such as garden hoses.

I claim:

1. A hand winder for winding and unwinding a line, cable or the like, said winder comprising a first generally U-shaped member located in a predetermined plane, said first U-shaped member including an elongated handle portion defining a payout handle and further comprising two substantially parallel line carrier arms extending from the ends of said pay-out handle, and a second generally U-shaped member located in a plane extending transversely of the plane of said first U-shaped member, said second U-shaped member including an elongated handle portion defining a wind-in handle extending substantially parallel to said pay-out handle and further including two connecting arms extending from the ends of said wind-in handle and connected to said carrier arms.

2. A hand winder as defined in claim 1 in which said connecting arms are joined integrally with said carrier arms and define angularly-directed elongations of said carrier arms.

3. A hand winder as defined in claim 1 in which said carrier arms are integral with said pay-out handle, said connecting arms being integral with said wind-in handle.

4. A hand winder as defined in claim 3 in which the ends of said connecting arms are connected to said carrier arms adjacent the junctions between said carrier arms and said pay-out handle.

5. A hand winder as defined in claim 1 in which the plane of said second U-shaped member is inclined at an angle of about 65 degrees relative to the plane of said first U-shaped member.

6. A hand winder as defined in claim 1 in which said carrier arms are inclined at an angle of about 7 degrees to a centre plane between said carrier arms so as to hinder unintentional winding of a wound line.

* * * * *